United States Patent [19]

Itoh

[11] 4,028,643

[45] June 7, 1977

[54] WAVEGUIDE HAVING STRIP DIELECTRIC STRUCTURE

[75] Inventor: Tatsuo Itoh, Menlo Park, Calif.

[73] Assignee: University of Illinois Foundation, Urbana, Ill.

[22] Filed: May 12, 1976

[21] Appl. No.: 685,627

[52] U.S. Cl. ..... 333/6; 333/10; 333/82 R; 333/84 R

[51] Int. Cl.² ..... H01P 3/16; H01P 3/20; H01P 5/18; H01P 7/00

[58] Field of Search ..... 333/84 R, 6, 84 M, 10, 333/95, 82 R; 350/96 WG, 96 C

[56] References Cited

UNITED STATES PATENTS

| | | | |
|---|---|---|---|
| 3,563,630 | 2/1971 | Anderson et al. | 333/84 M X |
| 3,785,717 | 1/1974 | Croset et al. | 333/95 R X |
| 3,840,828 | 10/1974 | Linn et al. | 333/84 R X |
| 3,903,488 | 9/1975 | Fong | 333/84 R |

*Primary Examiner*—Paul L. Gensler
*Attorney, Agent, or Firm*—Martin Novack

[57] ABSTRACT

The invention is directed to a waveguide for microwave electromagnetic energy. A conductive ground plane has a first layer of dielectric material disposed on its surface. A second dielectric layer overlays the first dielectric layer. The second dielectric layer has a higher dielectric constant than the first dielectric layer. An elongated dielectric strip is formed on the second dielectric layer, the strip having a width which is substantially less than that of the second dielectric layer. The strip is formed of a material having a dielectric constant which is less than the dielectric constant of the material comprising the second dielectric layer. In operation, the wave energy propagates in the second dielectric layer which has the highest dielectric constant. The dielectric strip provides a lens effect in the transverse direction so most of the wave energy is carried below the strip.

25 Claims, 6 Drawing Figures

WAVEGUIDE HAVING STRIP DIELECTRIC STRUCTURE

The invention herein described was made in the course of or under a contract or subcontract thereunder, with the Department of the Army.

BACKGROUND OF THE INVENTION

This invention relates to electromagnetic waveguides and, more particularly, to a waveguide having a strip dielectric structure.

In recent years, applications have been developed for the use of millimeter and submillimeter wave frequencies for the transmission of information. Conventional metal waveguides become quite lossy and difficult to fabricate as the wavelengths involved become shorter. As a result, alternatives to conventional microstrip techniques have been investigated. One suggested alternate technique for millimeter wave integrated circuits is the employment of so-called dielectric waveguide structures such as image guides and silicon waveguides. However, in these structures the waveguide boundaries are generally required to be extremely mechanically smooth so as to avoid radiation loss. To minimize losses due to surface roughness, costly technological processes are needed. Also, in the case of an image guide, conductor losses in the ground plane can be substantial due to the strength of the field near the conductor.

The conductor loss in microstrip lines is relatively large because the field is strong at the edges of the microstrip. In typical dielectric rod waveguides, there are no losses to the ground plane since there is none, but the absence of a ground plane can lead to inconvenience regarding heat sinking or application of a DC bias.

It is an object of the present invention to provide a waveguide which is responsive to the problems of the prior art as set forth.

SUMMARY OF THE INVENTION

The present invention is directed to a waveguide for microwave electromagnetic energy. As utilized herein, the term "microwave" is intended to generally include electromagnetic frequencies in the range of about 1 GHz to 150 GHz, and including the range generally referred to as "millimeter waves". Operation of the invention is particularly applicable to the millimeter-wave portion of the spectrum between about 30 and 150 GHz. In accordance with the invention there is provided a ground plane, typically formed of a conductive metal. A first layer of dielectric material is disposed on a surface of the ground plane. A second dielectric layer overlays the first dielectric layer. The second dielectric layer has a higher dielectric constant than the first dielectric layer. Finally, an elongated dielectric strip is formed on the second dielectric layer, the strip having a width which is substantially less than that of the second dielectric layer. The strip is formed of a material having a dielectric constant which is less than the dielectric constant of the material comprising the second dielectric layer. In operation, the wave energy propagates in the second dielectric layer which has the highest dielectric constant. The dielectric strip provides a lens effect in the transverse direction so most of the wave energy is carried below the strip. Losses in the conductive ground plane are minimized by the presence of the first dielectric layer. The ground plane can be utilized for heat sinking and/or application of DC bias.

In one preferred embodiment of the invention there is provided a conductive ground plane and an elongated dielectric strip disposed on a surface of the ground plane. A layer of dielectric material overlays the dielectric strip and substantially overlaps the edges thereof. The layer of dielectric material has a higher dielectric constant than the dielectric constant of the elongated strip. This being the case, most of the electromagnetic energy is carried in the dielectric layer immediately above the strip. This embodiment has the advantage of requiring only two dielectric layers. Losses in the first dielectric layer (of the first-mentioned embodiment) are thereby eliminated. Also, as in the previous embodiment, losses due to the roughness of edges are eliminated since the edges of the guiding layer are remote from the external boundaries of the electromagnetic energy. In one form of this embodiment, clamping means are provided to engage the ground plane and the dielectric layer so as to grip the dielectric strip therebetween. This is advantageous in that it removes the need for bonding materials which can introduce loss. A similar configuration can be utilized in conjunction with two or more dielectric strips whose relative positions can be readily adjusted in situ to effect coupling therebetween and/or to effect coupling to lumped components.

In accordance with further embodiments of the invention, microwave waveguide devices are provided in the general form of the just-described embodiment, but wherein the dielectric strips are disposed in configurations which provide various advantageous results. In one configuration, a pair of elongated dielectric strips are disposed in substantially perpendicular relationship, the strips having a gap angularly across the intersection thereof. This configuration is useful as a beam splitter type device. In a further configuration, first and second elongated strips have substantially parallel relatively closely spaced portions, the strips diverging angularly from each other at an end of the parallel portions. This configuration is useful as an adjustable distributed-type directional coupler. Finally, a configuration is disclosed wherein a dielectric strip is in the shape of a ring, this configuration being useful, for example, as a resonator.

Further features and advantage of the invention will become more readily apparent from the following detailed description when taken in conjunction with the accompanying drawings.

DESCRIPTION OF THE PREFERRED EMBODIMENT

Figure 1:
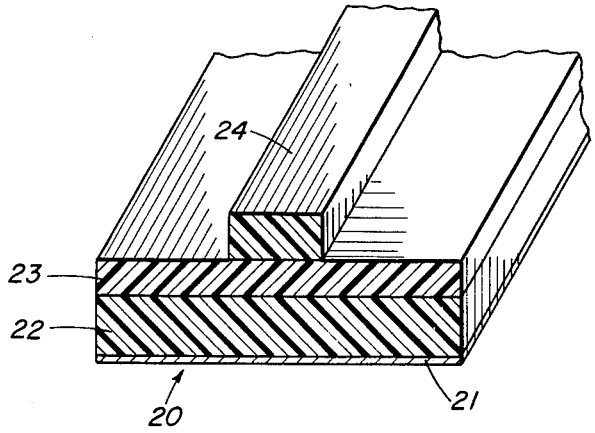
FIG. 1 is a sectional view of a waveguide in accordance with one embodiment of the invention.

Referring to FIG. 1, there is shown a microwave waveguide 20 in accordance with one embodiment of the invention. A ground plane 21 may be formed of any suitable conductive material. A first layer 22 of dielectric material having a dielectric constant $\epsilon_3$ is disposed on one surface of the ground plane 21. A second layer 23 of dielectric material having a dielectric constant $\epsilon_2$ overlays the layer 22. The materials are selected so that $\epsilon_2$ is greater than $\epsilon_3$. An elongated dielectric strip 24 is disposed on the layer 23, the strip 24 having a width which is substantially less than that of the dielectric layer 23. The strip 24 is formed of a material selected to have a dielectric constant $\epsilon_1$ which is less than the dielectric constant $\epsilon_2$ of the layer 23.

In operation of the embodiment of FIG. 1, microwave electromagnetic energy is introduced into the guiding layer 23, such as by a semiconductor device implanted therein. The strip 24 provides a lens effect and most of the electromagnetic energy is carried in the guiding layer immediately below the strip 24. Accordingly, losses due to surface roughness are reduced. The conductive ground plane 21 is available for use as a heat sink or for application of desired electrical signal, such as a DC bias level. The guiding level 23 may typically have a thickness of the order of an operating wavelength; e.g., 2–4 mm. for an 80 GHz. operating frequency. This is distinguished from the typical microstrip situation wherein moding considerations dictate that the line thickness be a fraction of a wavelength. The width of the strip 24 is also typically of the order of an operating wavelength. In one implementation of the invention, the following dielectric materials were utilized: $\epsilon_1$ and $\epsilon_3$ —Teflon having a dielectric constant of 2.1; $\epsilon_2$ — fused quartz plate having a dielectric constant of 3.8.

Figure 2:
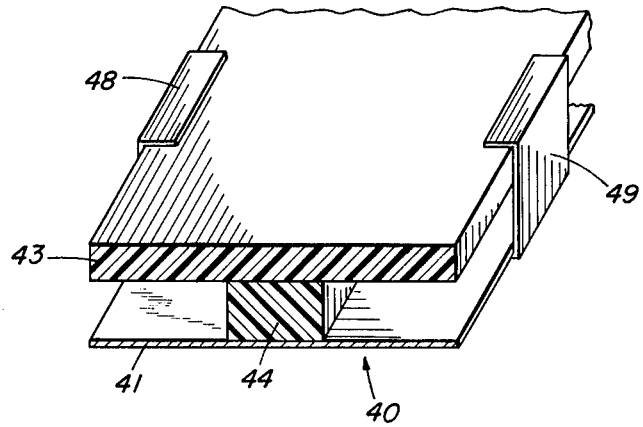
FIG. 2 is a sectional view of a waveguide in accordance with another embodiment of the invention.

FIG. 2 illustrates a preferred embodiment of the invention in which the dielectric strip (of dielectric constant $\epsilon_1$) and the guiding layer (of dielectric constant $\epsilon_2$) are inverted and the dielectric substrate (reference numeral 22 of FIG. 1) is omitted. In particular, in FIG. 2 a dielectric strip 44 is disposed on a ground plane 41 and a layer 43 of dieletric material overlays the strip 44 and substantially overlays the edges thereof. As previously noted, the dielectric constant of the guiding layer 43 ($\epsilon_2$) is higher than the dielectric constant of the strip material 44 ($\epsilon_1$). In operation, microwave energy is introduced into the guiding layer 43 and most of the energy is carried immediately above the strip, possible losses from surface roughness thereby being reduced. Once again, the ground plane 41 can be utilized as a heat sink and/or for applying desired electrical signals. In the embodiment of FIG. 2, clamps 48 and 49 engage the ground plane 41 and the dielectric layer 43, as shown, to grip the dielectric strip 44 therebetween. This is advantageous in that it eliminates the need for possibly lossy bonding materials. Again, the thickness of the guiding layer 43 may typically be of the order of an operating wavelength, as may be the case for the width of the strip 44. The elimination of the substrate 22 (of FIG. 1) prevents those losses which might occur in such layer in this embodiment.

Figure 3:
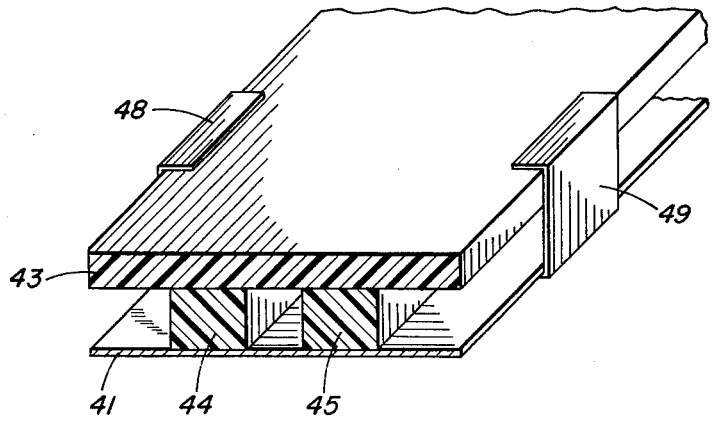
FIG. 3 is a sectional view of a waveguide in accordance with another embodiment of the invention.

FIG. 3 shows an embodiment of the invention which is similar to FIG. 2 except that an additional dielectric strip 45 is disposed between the ground plane 41 and the guiding layer 43. The degree of coupling as between the wave energy propagating in the guiding layer above the strips can be adjusted, in situ, as desired, and the degree of coupling to lumped elements can also be readily adjusted.

Figure 4:
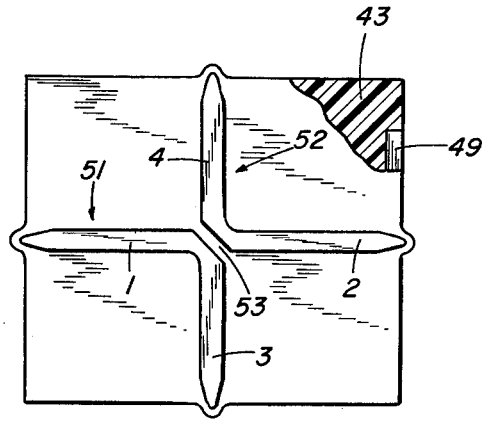
FIG. 4 is a partially cutaway plan view of one configuration of a waveguide device in accordance with the invention.
Figure 5:
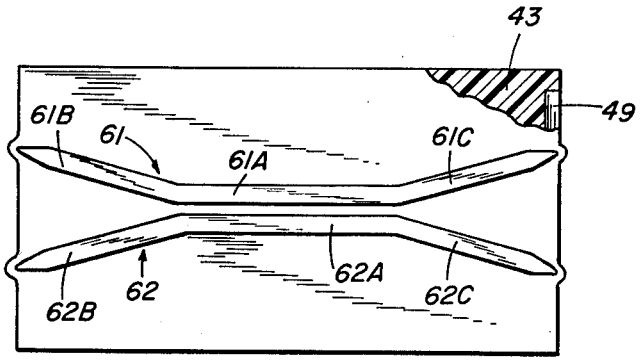
FIG. 5 is a partially cutaway plan view of another configuration of a waveguide device in accordance with the invention.
Figure 6:
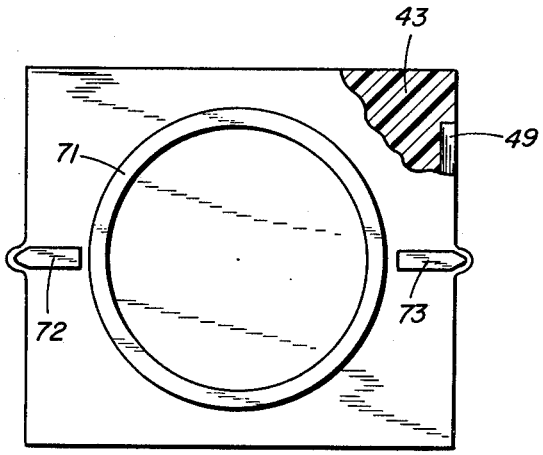
FIG. 6 is a partially cutaway plan view of another configuration of a waveguide device in accordance with the invention.

FIGS. 4, 5 and 6 are plan views of microwave waveguide devices which can be implemented utilizing various configurations of the embodiments shown in FIGS. 2 and 3. In the illustrations of FIGS. 4–6, the dielectric guiding layer 43 (see FIG. 3) is shown broken away for ease of illustration. In all three FIGS. 4–6 dimensions and materials may be as described hereinabove, and clamp means, such as is illustrated broken away at 49, may be employed to provide the advantages as were set forth. Tapered transitions are represented for possible coupling to external devices. The device of FIG. 4 operates in the manner of a beam splitter. A pair of substantially perpendicular intersecting strips 51 and 52 are disposed on the ground plane 41, a gap 53 being provided angularly across the intersection of the strips. The strip 51 includes legs designated 1 and 2 and the strip 52 includes legs designated 3 and 4. (In actuality, since the strips do not overlay each other, the legs 1 and 3 can be considered as one L-shaped pair of legs which opposes another L-shaped pair of legs 2 and 4 across the gap 53.) In operation, energy carried (mostly in the guiding layer 43) above the strip leg 1 will continue in part above leg 2, but a substantial portion of the wave energy will be diverted (at the 45°gap) angularly in the direction following strip leg 3. A very small percentage of the wave energy may follow the direction of leg 4.

In FIG. 5 there is shown a distributed-type directional coupler including spaced dielectric strips 61 and 62. The strips 61 and 62 have central parallel portions 61A and 62A and respective portions 61B, 62B and 61C, 62C which angularly diverge. In operation, if electromagnetic energy is introduced (in the guiding layer 43) along the direction of leg 62B, for example, a portion of the energy will leak into strip 61 due to the relatively close spacing as between the parallel portions 61A and 62A. Outputs can be taken at the leg portions 61C and 62C. Since the degree of coupling depends, inter alia, on the spacing between the parallel portions 61A and 61B, these can be readily adjusted to obtain a desired degree of coupling. As previously described, adjustability is particularly facilitated by eliminating bonding materials and utilizing clamping means 49.

In the embodiment of FIG. 6, the strip 71 is in the form of a ring and a pair of strips 72 and 73 serve as input and output couplers. By appropriately selecting the circumference of the ring 71, the device of FIG. 6 can be utilized, for example, as a resonator. To illustrate, if the length of the ring is made a mutliple of the elctromagnetic energy wavelenth, the wave energy will tend to add in phase as it recirculates the ring.

The invention has been described with reference to particular preferred embodiments, but variations within the spirit and scope of the invention will occur to those skilled in the art. For example, alternate materials and dimensions can be utilized, within the claim definitions as set forth, to achieve desired design objectives.

I claim:

1. A microwave waveguide, comprising:

a conductive ground plane;

a first dielectric layer disposed on a surface of said ground plane;

a second dielectric layer overlaying said first dielectric layer, said second dielectric layer having a higher dielectric constant than said first dielectric layer; and an elongated dielectric strip formed on said second dielectric layer, said strip having a width which is substantially less than that of said second dielectric layer said strip being formed of material having a dielectric constant which is less than the dielectric constant of said second dielectric layer.

2. The waveguide as defined by claim 1 wherein said second dielectric layer has a thickness which is of the order of a wavelength of electromagnetic energy to be carried therein.

3. The waveguide as defined by claim 2 wherein said first layer and said strip are formed of Teflon and said second layer is formed of quartz.

4. A microwave waveguide, comprising:

a conductive ground plane;

an elongated dielectric strip disposed on a surface of said ground plane; and a layer of dielectric material overlaying said strip and substantially overlapping the edges thereof, said dielectric layer having a higher dielectric constant than the dielectric constant of said strip.

5. The waveguide as defined by claim 4 further comprising clamp means for engaging said ground plane and said layer of dielectric material so as to grip said elongated dielectric strip therebetween.

6. The waveguide as defined by claim 4 further comprising at least one additional dielectric strip disposed on said surface of said ground plane and overlayed by said layer of dielectric material.

7. The waveguide as defined by claim 6 further comprising clamp means for engaging said ground plane and said layer of dielectric material so as to grip said dielectric strips therebetween.

8. The waveguide as defined by claim 4 wherein the thickness of said layer of dielectric material is of the order of a wavelength of electromagnetic energy to be carried therein.

9. The waveguide as defined by claim 5 wherein the thickness of said layer of dielectric material is of the order of a wavelength of electromagnetic energy to be carried therein.

10. The waveguide as defined by claim 6 wherein the thickness of said layer of dielectric material is of the order of a wavelength of electromagnetic energy to be carried therein.

11. The waveguide as defined by claim 7 wherein the thickness of said layer of dielectric material is of the order of a wavelength of electromagnetic energy to be carried therein.

12. A microwave waveguide device, comprising:

a conductive ground plane;

first and second substantially perpendicular elongated dielectric strips disposed on a surface of said ground plane, said strips having a gap angularly across the intersection thereof; and a layer of dielectric material overlaying said strips and substantially overlapping the edges thereof, said dielectric layer having a higher dielectric constant than the dielectric constant of the strips.

13. The device as defined by claim 12 further comprising clamp means for engaging said ground plane and said dielectric layer so as to grip said dielectric strips therebetween.

14. The device as defined by claim 12 wherein the thickness of said layer of dielectric material is of the order of a wavelength of electromagnetic energy to be carried therein.

15. The device as defined by claim 13 wherein the thickness of said layer of dielectric material is of the order of a wavelength of electromagnetic energy to be carried therein.

16. A microwave waveguide device, comprising:

a conductive ground plane;

first and second elongated dielectric strips having substantially parallel relatively closely spaced portions disposed on a surface of said ground plane, said strips diverging angularly from each other at an end of said parallel portions; and a layer of dielectric material overlaying said strips and substantially overlapping the edges thereof, said dielectric layer having a higher dielectric constant than the dielectric constant of said strips.

17. The device as defined by claim 16 wherein said strips also diverge at the other end of said parallel portions.

18. The device as defined by claim 17 further comprising clamp means for engaging said ground plane and said dielectric layer so as to grip said dielectric strips therebetween.

19. The device as defined by claim 17 wherein the thickness of said layer of dielectric material is of the order of a wavelength of electromagnetic energy to be carried therein.

20. The device as defined by claim 18 wherein the thickness of said layer of dielectric material is of the order of a wavelength of electromagnetic energy to be carried therein.

21. A microwave waveguide device, comprising:

a conductive ground plane;

a dielectric strip in the shape of a ring disposed on a surface of said ground plane; and a layer of dielectric material overlaying said strip and substantially overlapping the edges thereof, said dielectric layer having a higher dielectric constant than the dielectric constant of said strip.

22. The device as defined by claim 21 further comprising at least a second dielectric strip disposed between said ground plane and said layer of dielectric material, one end of said strip being adjacent the periphery of said ring-shaped strip.

23. The device as defined by claim 22 further comprising clamp means for engaging said ground plane and said layer of dielectric material so as to grip said strips therebetween.

24. The device as defined by claim 22 wherein the thickness of said layer of dielectric material is of the order of a wavelength of electromagnetic energy to be carried therein.

25. The device as defined by claim 23 wherein the thickness of said layer of dielectric material is of the order of a wavelength of electromagnetic energy to be carried therein.

* * * * *